United States Patent [19]

Jeffrey et al.

[11] 4,176,837

[45] Dec. 4, 1979

[54] ARM-WRESTLING APPARATUS

[76] Inventors: Lawrence W. Jeffrey, 1008 Juanita; Robert D. Jeffrey, 7121 Lowell Ave., both of Glendora, Calif. 91740

[21] Appl. No.: 820,585

[22] Filed: Aug. 1, 1977

Related U.S. Application Data

[63] Continuation-in-part of Ser. No. 617,428, Sep. 29, 1975, abandoned.

[51] Int. Cl.[2] ..... A63B 71/06

[52] U.S. Cl. ..... 273/1 R; 194/41; 272/67; 272/DIG. 5

[58] Field of Search ..... 273/1 R, 1 E, 29 B; 272/65, 67, 68, DIG. 5; 194/30, 41, 50, 76, 81, 86, 89, DIG. 11

[56] References Cited

U.S. PATENT DOCUMENTS

| | | | |
|---|---|---|---|
| 1,487,631 | 3/1924 | Wanger | 272/68 |
| 3,467,376 | 9/1969 | Feinberg | 272/67 X |
| 3,635,471 | 1/1972 | Caron | 272/65 |
| 3,649,010 | 3/1972 | Jeffrey et al. | 273/1 E |
| 3,735,983 | 5/1973 | Ortiz | 273/1 |
| 4,063,727 | 12/1977 | Hall | 272/67 X |

*Primary Examiner*—William H. Grieb
*Attorney, Agent, or Firm*—Boniard I. Brown

[57] ABSTRACT

A coin-operable amusement device which provides table equipment and scoring apparatus for arm wrestling contests. For each player there is provided an elbow cup, a fixed handle for the player's free hand, and a touch pad which actuates a scoring indicator. When the losing player's arm is forced down against a touch pad, signal devices operate. In one form the touch pads are depressible for a substantial distance and carry pointers movable along scales which are calibrated in game points. Friction linkages make the pointers remain where deflected. Means are provided to prevent play unless a coin has been inserted into a coin acceptor. One such means comprises a depressible support under each elbow cup, which is locked up in place only when a coin has been inserted. An alternative means is a bar-like blocking element disposed so as to interfere with play when it is raised above the table top. When a coin is inserted, an automatic mechanism lowers the blocking bar out of the way. Fixed handles for the players' free hands may be provided, with thumb-actuated pushbutton switches which energize a "READY" signal when both are depressed.

7 Claims, 14 Drawing Figures

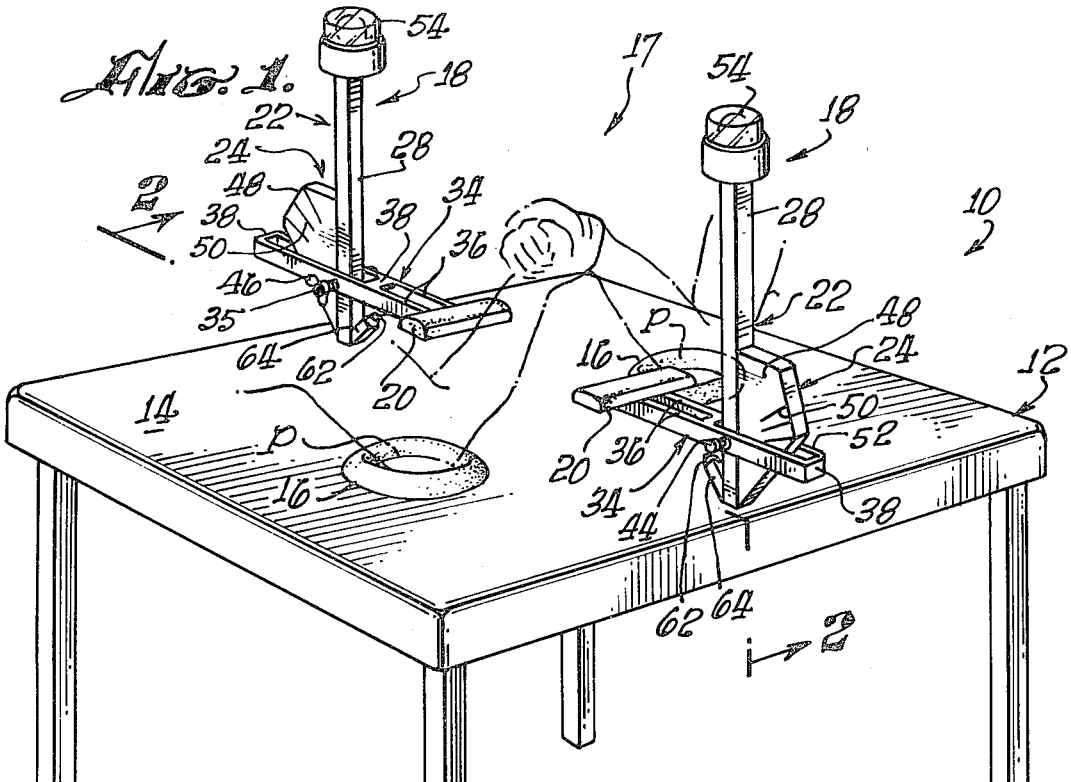
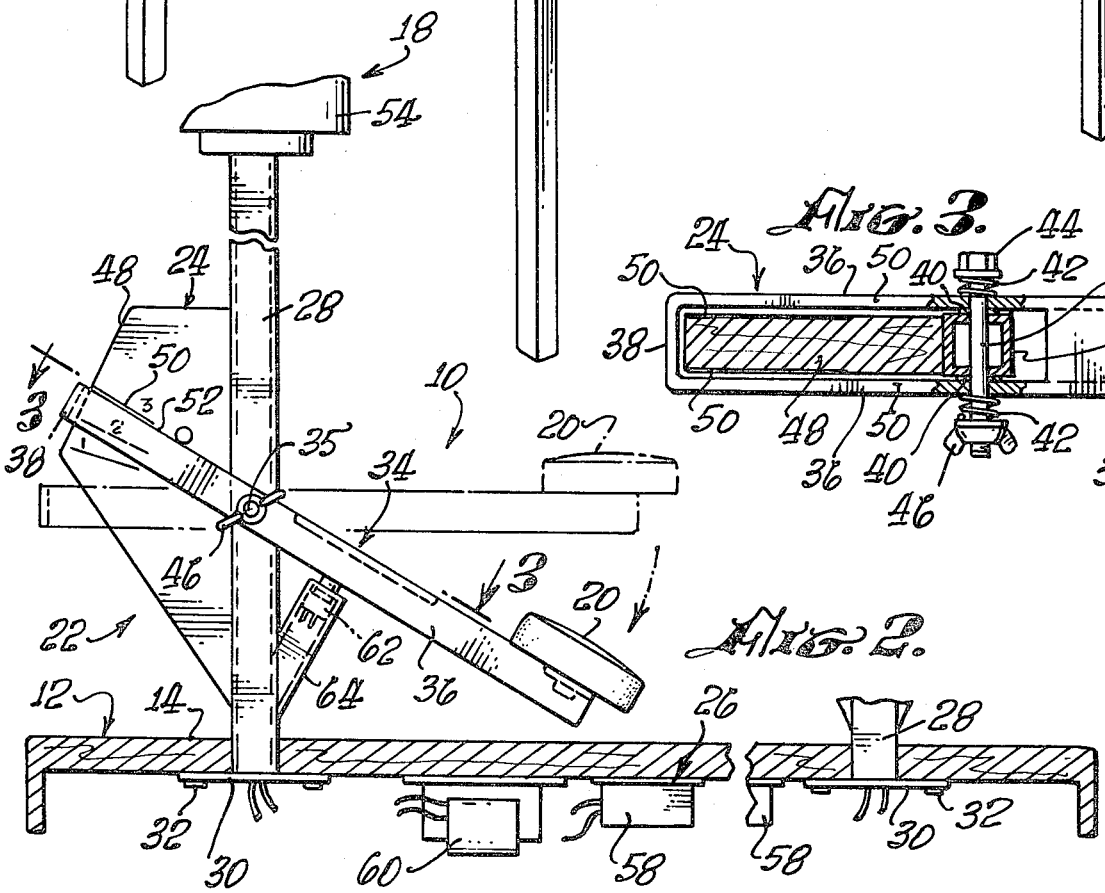
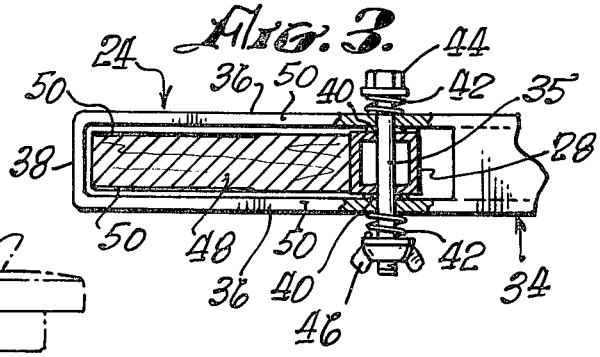
FIG. 2.

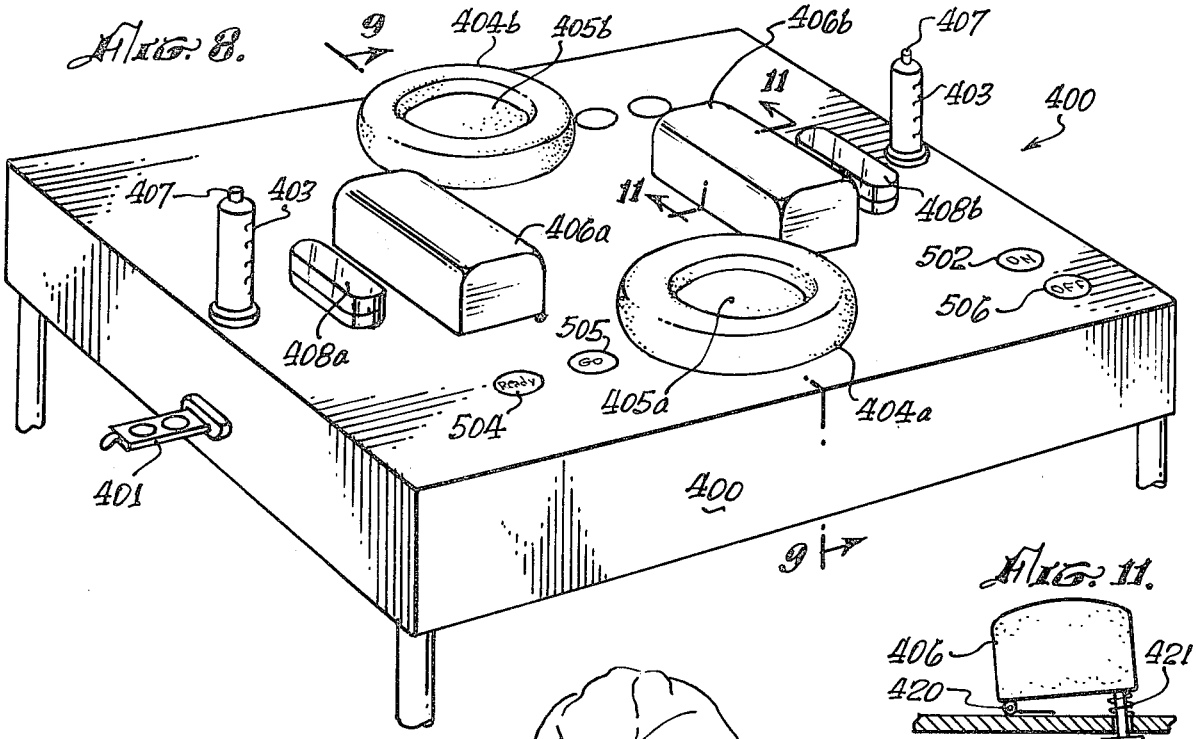
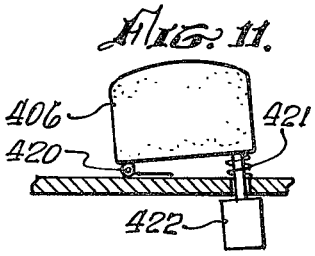
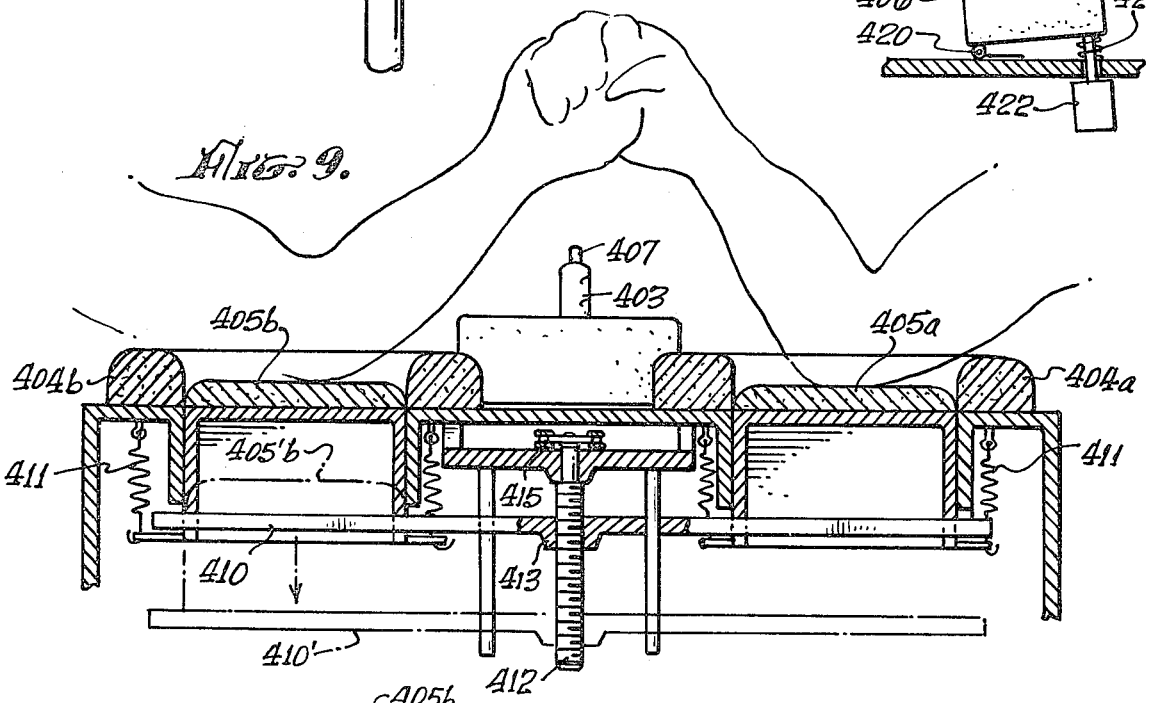
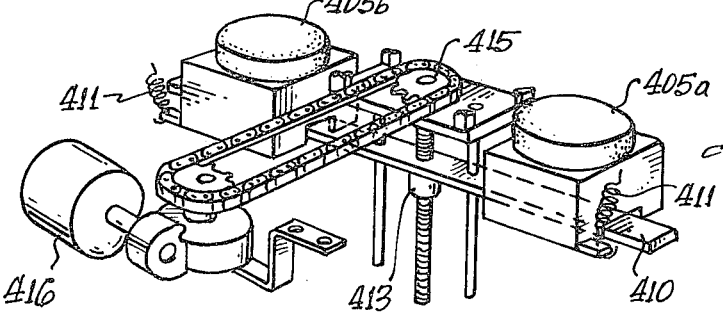
Fig. 10.

ARM-WRESTLING APPARATUS

CROSS-REFERENCE TO RELATED APPLICATION

This is a continuation-in-part of our U.S. application Ser. No. 617,428, filed Sept. 29, 1975, now abandoned.

BACKGROUND

This invention relates to amusement apparatus such as is found in amusement parks. In particular it relates to coin-operated apparatus for use by two persons for practicing the old sport of arm wrestling. Such apparatus comprises a suitable table, elbow cups to fix the players' elbow positions, fixed handles for the free hand of each player, and automatic scoring indicator devices and the like.

Our prior U.S. Pat. No. 3,649,010 shows one form of an arm-wrestling apparatus with elbow cups and automatic scoring means. When one player forces the other's arm down to a point that signifies a score or win, an electric contact actuates a suitable indicator. U.S. Pat. No. 3,735,983 to J. L. Ortiz shows another apparatus for such scoring which provides touch pads that actuate electrical contacts. Another showing of apparatus of this class is in U.S. Pat. No. 3,467,376.

BRIEF SUMMARY

This invention provides improved amusement and scoring apparatus for arm-wrestling which includes a pair of depressible touch pads mounted on the table top or the like being used for an arm-wrestling contest or game. The game is also called wrist-wrestling. Two depressible pads are located at opposite sides of the fixed elbow positions for engagement and depression by a losing contestant's arm or wrist. The pads actuate switch means to operate signal lights and the like.

In one embodiment of the invention, depression of a touch pad moves a pointer across a scale to indicate how far a pad has been depressed short of a complete "win". Frictional linkage or pivot means make the pointer stay at the point it has been pushed to. The scale is calibrated in suitable game points. At the bottom of the available travel of the pad, contacts may actuate, as before, suitable light signals, buzzers, or the like, to signal a win.

A coin-operated apparatus of the invention has lockout means to prevent its use when no coin has been fed into the coin acceptor. One such lockout means comprises depressible elbow rests which move freely downward unless they are locked in the "up" position necessary for play. The coin mechanism actuates a locking device to hold the elbow pads up.

An alternative coin-operated means employs a blocking element or bar in the middle of the table which a mechanism raises up to interfere with play. After a coin has been inserted, the mechanism lowers it down to the table top, out of the way.

A fixed handle is preferably provided for each player's free hand, to provide standardized playing conditions. Each handle may be provided with a suitable push-button switch or grip switch. When both players are in proper position, they each signal "ready" by pressing a handle switch, and a "READY" indicator lamp lights.

DETAILED DESCRIPTION

In the drawings:

FIG. 1 is a perspective view of an apparatus of the invention;

FIG. 2 is a section on line 2—2 of FIG. 1;

FIG. 3 is a section on line 3—3 of FIG. 2;

FIG. 8 is a perspective view of a coin-operated apparatus having depressible lockable elbow rests;

FIG. 9 is a section on line 9—9 of FIG. 8;

FIG. 10 is a perspective detail of a locking mechanism;

FIG. 11 is a side detail of another touch pad;

Figure 4:
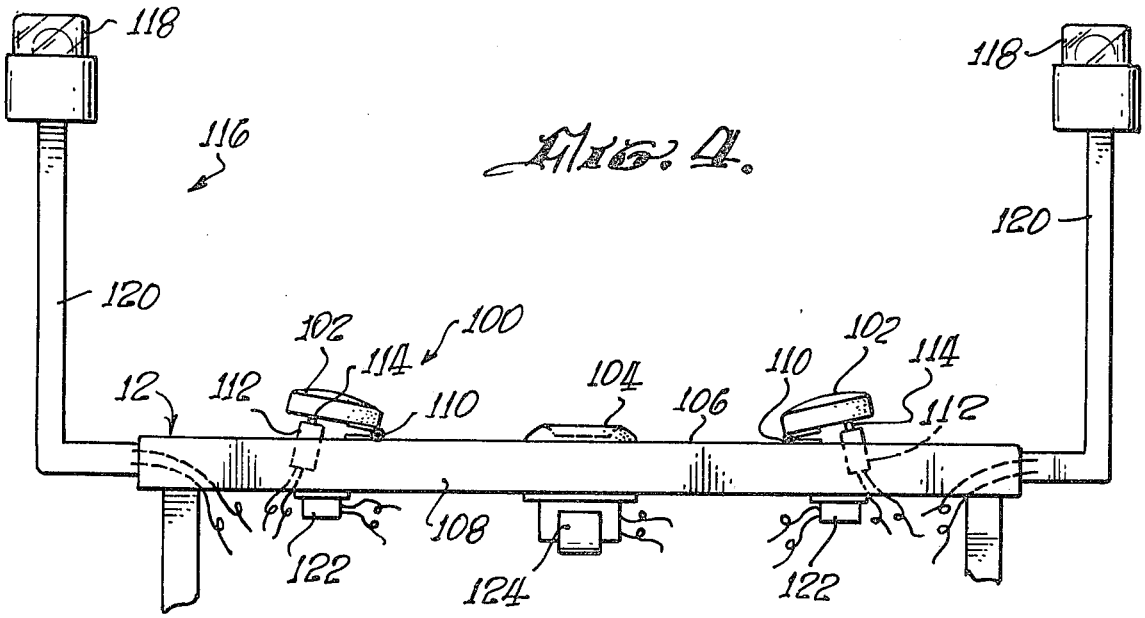
FIG. 4 is a side elevation of a modification.

Referring first to FIGS. 1–3, an arm-wrestling apparatus 10 comprises a support 12, such as a suitable table, having an upper top or horizontal supporting surface 14 for the contestants' elbows. Fixed to this surface are a pair of elbow rests or cups in which the players place their elbows as illustrated in broken lines in FIG. 1. These elbow rests or cups, which are described in my earlier-mentioned prior U.S. Pat. No. 3,649,010 and form no part of the present invention, define fixed positions P for the contestants' elbows.

In a conventional arm-wrestling match without the aid of scoring apparatus, each scoring position is that in which the contestants' forearms extend generally parallel to the surface 14 with the hand and/or wrist of one contestant in contact with the surface. This position constitutes a win or score for the other contestant. It is often quite difficult to determine when a contestant has thus won or scored.

This invention provides scoring apparatus 17 for eliminating this problem. It comprises a pair of touch pad means 18 mounted on the elbow support 12 at opposite sides of the fixed elbow positions P. These touch pad means include depressible touch pads 20 which are located at opposite sides of the fixed elbow positions for engagement and depression by the contestants' hands when their forearms are down in scoring position. Each touch pad means 18 also includes means 22 for indicating depression of the corresponding touch pad 20. In this particular inventive embodiment, which is particularly suited for use in team wrestling matches, the depression indicating means 22 of each touch pad means 18 comprises point readout means 24 for displaying the distance through which the corresponding touch pad 20 is depressed from its normal or undepressed position, to permit awarding of numerical scores to the contestants and electrically actuated signal means 26 which are activated in response to depression of a touch pad through its full range of depression.

In this embodiment, the contestants complete in the usual way with their elbows positioned in the elbow cups 16. Upon movement of the contestants' forearms to either scoring position, a contestant's hand is pressed against a corresponding touch pad 20, depressing the pad and actuating the indicating means 22. The maximum distance through which the pad has been depressed may be observed on the readout means 24 which is calibrated in terms of game points which may be awarded to the scoring contestant. Actuation of the electrical signal means 26 indicates that the touch pad has been depressed through its full range of depression and that a scoring contestant has won.

Referring now in more detail to FIGS. 1 through 3, each touch pad means 18 comprises an upstanding post 28 which is shown as a hollow rectangular tube. The lower end of this post extends through an opening in the top of table 12 and is welded or otherwise rigidly joined to a mounting plate 30 which is firmly attached by screws 32 to the underside of the table top. Extending laterally of the post 28 at a position relatively close to, but spaced from, the elbow-supporting surface 14 is a pivoted cross arm 34. This cross arm has a pair of spaced parallel arm members 36 which are rigidly joined by connecting webs 38 and straddle the post 28. Cross arm 34 is pivotally attached to the post 28 by a pivot bolt 35 which extends through the cross arm members 36 and the post. Interposed between the post 28 and the cross arm members 36 are washers 40 (FIG. 3). A compression spring 42 is mounted on the bolt 35 between the bolt head 44 and the adjacent cross arm member 36, and a second compression spring 42 is mounted on the bolt between a nut 46 threaded on the bolt and the adjacent cross arm member 36. Referring to FIG. 3, it will be seen that the springs 42 exert inward pressure against the cross arm members 36, tending to urge the arm members inwardly toward the post 28, and that the nut 46 may be threaded on the bolt to increase and reduce this spring pressure. The spring pressure is provided to cause friction in the pivot joint.

As shown in FIG. 1, the posts 28 are located at opposite sides of a line passing through the centers of the elbow cups 16, and hence through the elbow positions P, and substantially in a common plane passing midway between the elbow cups substantially normal to their line of centers. The pivot axes of the touch pad cross arms 34 parallel one another and approximately parallel the line of centers between the elbow cups. Accordingly, the cross arms 34 have inner ends which extend inwardly toward the line of centers of the elbow cups and opposite outer ends. The inner extending portion of the cross arms are somewhat longer than their outer ends, as at 38.

The touch pads 20 are rectangular cushioned pads which are firmly attached to and extend crosswise of the inner extremities of the cross arms 34. In the normal positions of these pads, shown in FIG. 1 and in broken lines in FIG. 2, the cross arms 34 are horizontal. It will be understood, of course, that the cross arms are located the same distance above the elbow-supporting surface 14, such that in these normal positions the touch pads are located in a common plane parallel to and spaced some distance above the elbow-supporting surface 14. As may be observed in the drawings, the touch pads 20 are located at opposite sides of the elbow cups 16 and provide the fixed elbow positions P for engagement and depression by the contestants' hands in the scoring positions referred to earlier.

As noted earlier, the compression springs 42 of each touch pad means 18 exert inward pressure against the cross arm members 36, tending to deflect these members inwardly toward the post 28. According to the present invention, the spring pressure is adjusted by means of the nut 46 on the pivot bolt 35 to effect frictional retention of the cross arm 34 in fixed position relative to the post 28. Accordingly, a cross arm 34 will remain in any angular position relative to its post 28, to which it has been pushed, until a downward force is exerted on the arm.

At the beginning of play, the touch pads 20 are placed in their initial positions of FIG. 1 and, as shown above, will remain in these positions. During a match, movement of a contestant's forearm to a scoring position pushes the corresponding touch pad downward, depressing it toward the elbow-supporting pad or surface 14. As noted earlier, the amount of such depression is indicated by the indicating means 22.

The readout means 24 of each touch pad means 18 comprises a scale plate 48 which is attached to the outer side of the corresponding post 28 and is straddled by the outer ends of the cross arm members 36. Marked on this scale plate are indicia constituting a scale across which the outer end of the cross arm 34 moves as a pointer to indicate the distance through which the touch pad 20 has been depressed from its normal position. In the particular embodiment illustrated, the upper outer edge 52 of the front cross arm member 36 serves as a reference or pointer against which the scale 50 is readable to indicate the depression distance of the touch pad. Scale 50 is calibrated in terms of scoring points, e.g., 1 to 3, which may be awarded to a contestant. It will be understood, of course, that the scale 50 reads zero when the touch pad 20 occupies its normal pre-game position. In the particular embodiment shown, maximum or full range depression of the touch pad corresponds to three points on the scale 50.

The electrical signal means 26 of each touch pad means 18 comprises a lamp 54, preferably a rotating or flashing beacon, mounted on the upper end of the post 28. The leads of the lamp extend downwardly through the hollow interior of the post. The electrical signal means 26 may also include a buzzer 58.

Signal lamp 54 and buzzer 58 of each touch pad means 18 are energized from a suitable transformer 60 through a switch 62 mounted on a switch bracket 64 secured to the lower end of the post 28. Switch 62 is arranged to be actuated, to energize the lamp 54 and the buzzer 58, by contact with the cross arm 34 upon downward depression of the touch pad 20 to its lower limiting position shown in full lines in FIG. 2.

The operation of the arm-wrestling scoring apparatus 17 will now be described. At the start of a match, the touch pads 20 are elevated to their normal pre-game positions of FIG. 1. The signal lamps 54 and buzzers 58 of the touch pad means 18 will then be de-energized. If, in the course of the wrestling match, either contenstant succeeds in pressing his opponent's arm to a scoring position, the corresponding touch pad 20 will be depressed. If the touch pad is only partially depressed, the corresponding signal lamp 54 and buzzer 58 will remain de-energized. In this case, the amount of depression of the touch pad is observed on the scale 50 and recorded for subsequent awarding of the corresponding number of points to the contestant. The wrestling match may continue until one or the other of the contestants succeeds in pressing his opponent's arm sufficiently hard down to effect full depression of the corresponding touch pad 20. When this occurs, the corresponding switch 62 is actuated to energize the signal lamp 54 and buzzer 58, and thereby signal the end of the match.

Turning now to FIG. 4, there is illustrated a modified scoring apparatus 100 according to the invention. It comprises a pair of cushioned rectangular touch pads 102 located at opposite sides of a pair of elbow cups 104 (only one shown) secured to the top elbow support surface 106 of a wrestling table 108. The longitudinal edges of the touch pads parallel one another and approximately parallel the line of centers between the elbow cups and extend normal to the plane of the paper in FIG. 4. The touch pads are pivotally attached, along their adjacent inner longitudinal edges, to the surface 106 by hinges 110. Mounted on the table 108, below the outer edges of the touch pads 102, are electrical switches 112 having plungers 114 which engage the under sides of the pads. These plungers are biased upwardly toward the pads by springs (not shown) contained in the switches. The touch pads are depressible downwardly against the force of these switch springs to actuate the switches and are returned upwardly by the springs when the pads are released. As in the previous embodiment of the invention, the touch pads 102 are disposed at opposite sides of the elbow cups 104 for engagement and depression by the clasped hands of the contestants' wrestling arms when their forearms move to scoring positions.

The scoring apparatus 100 also includes indicating means 116 for indicating depression of the respective touch pads 102. In this case, the indicating means 112 comprise signal lamps 118, which are preferably rotating or flashing beacons, mounted on the upper ends of supporting posts 120 attached to the table 108, in the manner shown in FIG. 4, and buzzers 122 secured to the underside of the table. The switch 112, signal lamp 118, and buzzer 122 for each touch pad 102 are connected in circuit with one another and with a transformer 124 secured to the underside of the table, so that depression of the pad energizes the lamp and buzzer.

The arm-wrestling apparatus of FIG. 4 is used in essentially the same manner as that of FIGS. 1 through 3. Accordingly, no further description of the modified scoring apparatus is deemed necessary, except to say that the apparatus is operative only to indicate the winner of a wrestling match and has no provision for awarding of point scores to the individual contestants.

Figure 5:
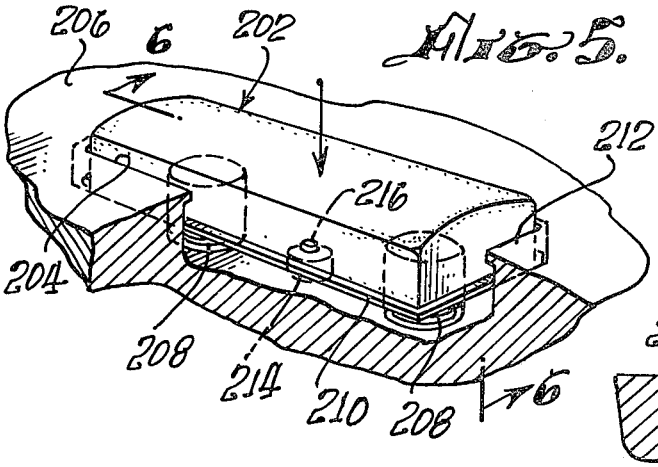
FIG. 5 is a perspective view of a modified touch pad for actuating scoring devices.
Figure 6:
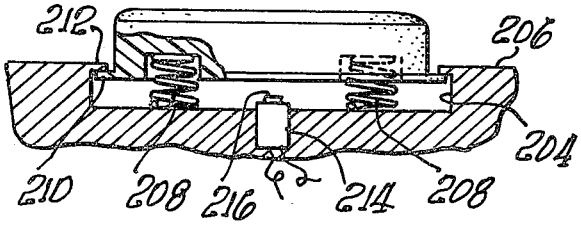
FIG. 6 is a section on line 6—6 of FIG. 5.

In the inventive embodiments described thus far, the touch pads, when fully depressed, project above the elbow-supporting surface. This may present a safety hazard in some cases, as in a wrestling match between relatively powerful contestants, due to the possibility of a contestant's wrist being bent to the point of injury about the edge of a pad following particularly hard contact of the contestants' hands with the pad. FIGS. 5 and 6 illustrate a modified touch pad arrangement according to the invention which eliminates this safety hazard. In this case, the cushioned rectangular touch pad 202 is mounted within a complementary recess 204 in the elbow-supporting surface 206 of the wrestling table. Acting between the bottom of this recess and the bottom of the touch pad are compression springs 208 for urging the touch pad upwardly to its extended position of FIG. 6, wherein a stop shoulder or flange 210 about the bottom of the touch pad engages a coacting stop shoulder or flange 212 about the open top side of the recess 204. Mounted at the bottom of the recess 204 is a switch 214 having an upper plunger 216 which is engaged and depressed by the touch pad 202, to actuate the switch, when the touch pad is depressed to its position of FIG. 5. Switch 214 actuates the indicating means (not shown) for indicating depression of the touch pad.

When in its extended position of FIG. 6, the touch pad 202 projects a distance above the wrestling table surface 206 for engagement and depression of the pad by the contestants' hands during a wrestling match. In its depressed position of FIG. 5, however, the upper surface of the pad is relatively flush with the table surface, thus eliminating the safety hazard discussed above.

Figure 7:
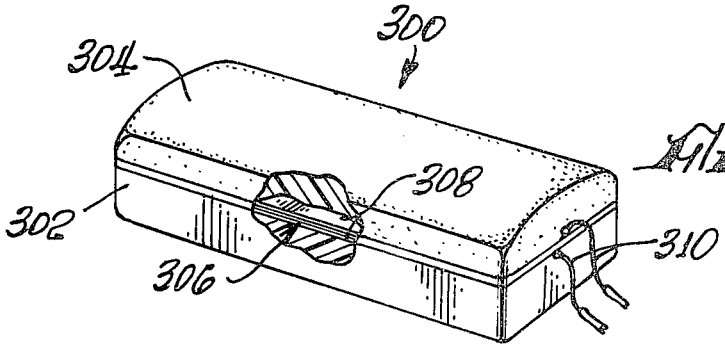
FIG. 7 is a perspective of another modified touch pad.

The modified touch pad 300 of FIG. 7 comprises a base member 302 and a pad cushion 304 overlying and secured to the base member. The cushion 304 may be constructed of foam rubber or other suitable resilient material. Interposed between the touch pad base member 302 and cushion pad 304 is a switch tape 306 including switch tapes 308 which are secured to the base member and the pad, respectively, one over the other. These switch tapes are attached to leads 310 extending from one end of the touch pad.

In the absence of any downward pressure on the cushion pad 304, the switch tapes 308 are spaced and thus present an open circuit between the switch leads 310. Downward pressure at any point on the pad 304 forces the switch tapes 308 into contact with one another, thereby completing an electrical circuit between the switch leads 310. This modified touch pad may be mounted directly on the elbow-supporting surface of the wrestling table or within a recess in the table, in the manner of the touch pad in FIGS. 5 and 6.

In addition to the possible uses described thus far for scoring apparatus according to the invention, such apparatus may be also installed in clubs, bars, cocktail lounges, and other public or private facilities for use by the patrons and may, if desired, be equipped with a coin mechanism for activating the apparatus.

FIGS. 8–14 show game apparatus of the coin-operated type. The main features are the novel means provided to prevent use of the apparatus without inserting a coin.

FIGS. 8–10 show such an apparatus where the prevention or "lockout" means is in a special support means for theelbow pads. When no coin has been fed into the slot the elbow pads are unsupported, except for light springs, and are free to sink downward into the table top for a distance of several inches or so. This makes wrist-wrestling impossible. When a coin has been inserted, a lockout drive mechanism automatically moves a support bar or lock bar into position under both elbow pads, holding them up solidly in position and permitting play to proceed.

In FIG. 8, a perspective view of this modification built on a table or the like indicated generally at 400, the elbow pads are shown at 405*a* and 405*b*, each surrounded by a circular cushion-like elbow cup 404*a*, 404*b*, respectively, generally like the cups 16 in FIG. 1. Referring now to FIGS. 9–10, the elbow-support pads 405*a*, 405*b*, are shown in section in the "up" or playing position. They are shown in phantom lines as at 405'*b* in the depressed, play-inhibiting or lockout position. Each pad is preferably connected to the table top by light springs 411 which permit it to be pushed freely downward unless the locking bar is up in place. The locking bar is shown at 410 in the "up" or playing position and in phantom lines 410' in the depressed position, which it occupies when no coin has been inserted in the coin acceptor 401 (FIG. 8).

The elbow pad-locking mechanism is shown further in FIG. 10. Pad-locking bar 410 extends under both elbow pads 405*a*, 405*b* and carries a nut 413 in its center. A screw 412 is rotated by a suitable gearhead motor or the like 416 via a suitable drive, such as a chain and sprocket, indicated generally at 415. When a coin is inserted in coin acceptor 401, suitable circuitry applies drive power to the motor 416, which rotates the screw 412 and elevates the locking bar 410 up to support the elbow pads 405*a*, 405*b* in playing position. A suitable limit switch means, not shown, is employed to turn off the motor 416 when the locking bar is at either end of its travel. Other suitable circuitry of known type energizes the motor 416 in reverse when one of the touch pads has been actuated to signal the end of the game. The motor 416 then screws the locking bar 410 back down into the "lockout" position.

FIG. 11 is a side sectional view of a touch pad for scoring, showing a preferred construction. The pad 406 is hinged to the top of table 400 by a suitable hinge 420. A suitable plunger-actuated switch 422 or the like is mounted under a hole in the table top, disposed to have its plunger 421 pushed down by the side of the pad 406 opposite the hinge side. A suitable compression spring 421 is provided to bias the pad upward.

Figure 12:
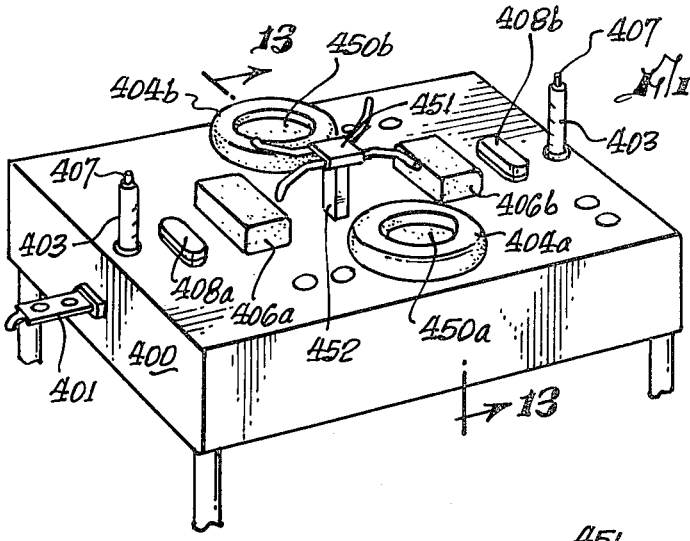
FIG. 12 is perspective view of a modified coin-operated apparatus with a blocking bar.
Figure 13:
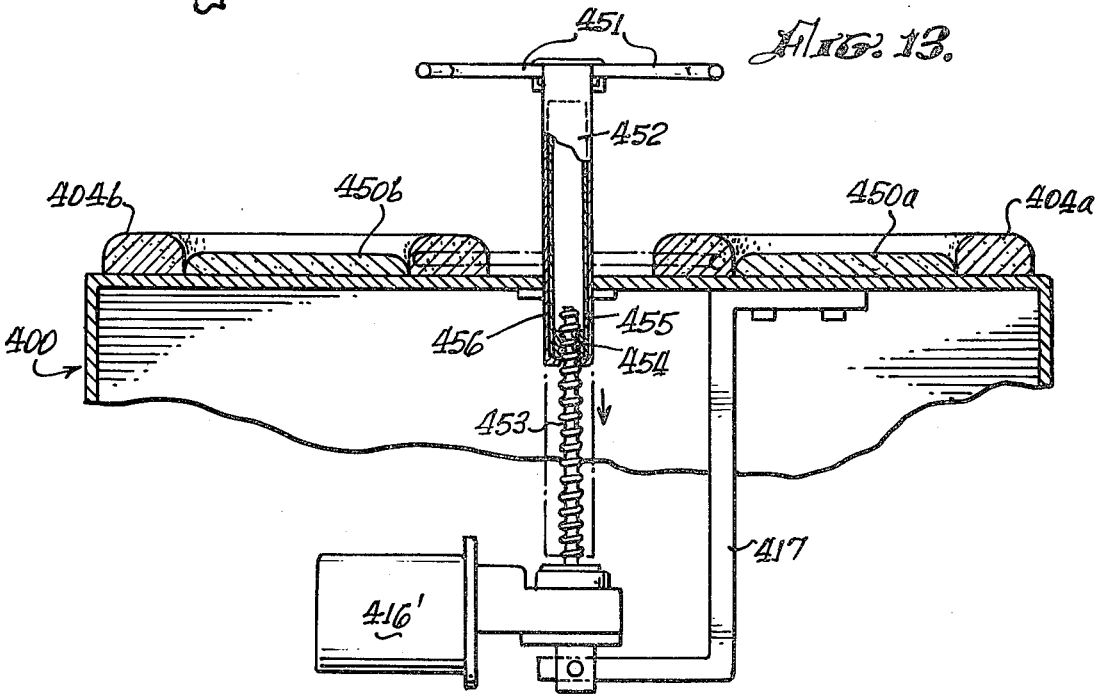
FIG. 13 is a section on line 13—13 of FIG. 12.

FIGS. 12 and 13 show an alternative form of lockout means to prevent arm-wrestling play when no coin has been inserted in the acceptor 401. The perspective view of FIG. 12 is the same as FIG. 8, except for the lockout device 451. This device is herein called a blocking bar. Preferably it has a spider-like shape as shown with four generally radiating arms. These arms are so disposed that they will lie flat on the table, clearing the elbow cups 404*a*, 404*b* and the touch pads 406*a*, 406*b*, to permit normal play when the bar 451 is in the "down" position. A drive mechanism lowers the blocking bar 451 to this "down" position when the coin acceptor 401 is actuated. When the coin acceptor has not been actuated by the insertion of a coin, or the game is over, however, the drive mechanism raises the blocking bar 451 up to a blocking or "lockout" position 30 cm or so above the table. When it is in this raised position, it interferes with players' arms, preventing scoring and making arm-wrestling impossible.

FIG. 13 shows the lockout means drive mechanism for raising and lowering the blocking bar, in simplified form. In this sectional view, the blocking bar 451 is attached to a hollow sleeve 456 which extends vertically through a hole in the table 400. A screw 453, which may be a ball screw of known type, actuates a suitable nut 454 which is so disposed as to raise and lower the bar 451. The screw 453 may be rotated in either direction by a reversible motor means 416', which may be a suitable small gearhead motor like motor 416 of FIG. 10. When the coin acceptor 401 is actuated by inserting a coin in it, suitable circuitry, not shown in FIG. 13, turns on the motor 416' in a direction to lower the blocking bar 451 down to table level to permit the players to wrist-wrestle. After a "win" has been signaled by the closure of one of the switches under touch pad 406*a* or 406*b*, the motor is started in reverse and rotates screw 453 to raise blocking bar 451 into blocking or "lockout" position.

A safety feature is provided to prevent a person's hand being caught under the blocking bar as the motor is pulling it down. This "free-wheeling" or safety sleeve feature comprises sleeves 455 and 456. Sleeve or tube 455 is fixed to the ball screw nut 454. Means, not shown, are provided to prevent rotation of this sleeve so that the screw will screw it up and down. A second sleeve 456 is attached to the blocking bar 451 at its top end and is a free-sliding fit over the driven sleeve 455. Thus, the blocking bar can be freely pulled upward by hand, but cannot be pushed downward when the motor has raised it into blocking position. Guide and stop means, not shown, are provided to prevent rotation of bar sleeve 456 and to prevent its removal from above. These may be of any suitable known design.

The motor means 416', FIG. 13, may be supported on a suitable bracket 417 as shown.

Figure 14:
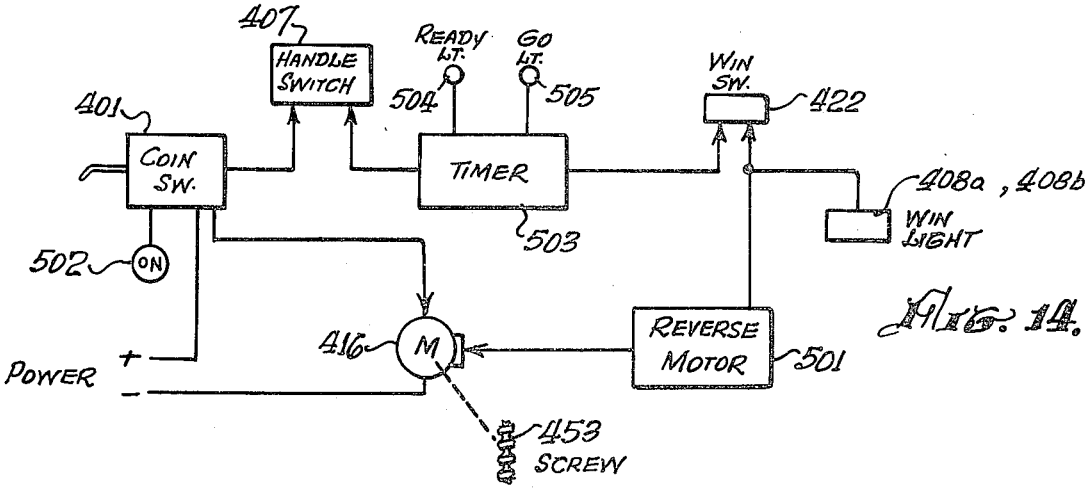
FIG. 14 is a simplified electrical block diagram.

FIG. 14 is a simplified block diagram of a suitable electrical circuit for controlling signal lights, blocking devices, and the like. A sequence of operation is as follows. At the start, the blocking device, whether the locking bar of FIGS. 8–9 or the blocking bar of FIGS. 12–13, is in the "blocking" lockout position to prevent play, and a suitable "OFF" indicator lamp 506 (FIGS. 8, 14) is lit. A coin is inserted in the coin acceptor 401, FIG. 14, closing contacts which start motor 416. Motor 416 actuates the blocking device, such as bar 451, into the non-blocking or "play" position and lights an "ON" indicator 502. The players sit down, and each grasps one of the free-hand handles 403 and depresses its thumb-switch push-button 407 (FIGS. 8, 12, 14). Both handle switches are connected in series. When both are closed, FIG. 14, a "READY" lamp 504 lights and a timer 503 is started. After a suitable interval, such as several seconds, the timer causes a "GO" indicator lamp 505 to light. The players proceed to wrist-wrestle. When one player forces the other's wrist against his touch pad 406*a* or 406*b*, a switch 422 is closed (see 422 in FIG. 11). Either such "win" switch will actuate a motor-reversing relay 501, FIG. 14, and a "WIN" indicator lamp 408*a* or 408*b* lights. These last-mentioned lights are preferably conspicuous in appearance and may be equipped with flashers. The motor-reversing relay 501 causes the motor 416 or the like to actuate the blocking device into the blocked position, as by raising the blocking bar 451 or by lowering the lock bar 410 of FIG. 9.

We claim:

1. Arm-wrestling amusement apparatus comprising:

a coin acceptor, a table-like playing surface, a pair of elbow rest cups thereon, each having a flat central pad portion and a surrounding cup rim portion, a pair of depressable touch pads for scoring, each linked to an electrical pad switch operable in response to depression thereof, electrical signal means actuably connected to each said pad switch, lockout means with a lockout element movable to prevent use of said apparatus for arm-wrestling, motor drive means to drive said lockout element between a lockout play-preventing position and an unlocked playing position, a connection from said coin acceptor to said drive means to drive said lockout element to said playing position upon receipt of a coin therein, and a connection from each said pad switch via a reversing means to said drive means to drive said lockout element to said lockout position after a said pad switch has been actuated.

2. Apparatus as in claim 1, further comprising:

a pair of handles fixed to said surface and disposed to be grasped by the free non-wrestling hand of each player, handle switch means on each said handle, and an indicator lamp connected to be lighted when both said handle switches are closed.

3. Apparatus as in claim 1, wherein:

said lockout means comprises a mounting means of said central pad portions making them substantially freely movable downward in depression to a lower position which inhibits their use for wrist-wrestling, and said lockout element is a locking bar means movably connected to said drive means for displacement between a lockout position clear of said pad portions, and a playing position which solidly supports said pad portions to prevent motion downward.

4. Apparatus as in claim 3, wherein:

said drive means comprises a motor connected to a screw means, and a nut on said locking bar engaged therewith, said motor thereby driving said locking bar up and down between said lockout position and said playing position.

5. Apparatus as in claim 1, wherein:

said lockout means comprises a blocking bar means extending generally radially and horizontally above said surface between a raised position constituting a lockout position, and a lowered position substantially down against said surface constituting a playing position, said bar in said raised position interfering preventably with the use of a player's arm in wrist-wrestling and not so interfering in said playing position, said motor drive means being connected mechanically to a central portion of said blocking bar means to raise and lower it.

6. Apparatus as in claim 5, wherein:

said drive means comprises a screw extending vertically and a nut connected to said blocking bar means, and said motor means being drivably connected to said screw.

7. Apparatus as in claim 6, further comprising:

safety sleeve means between said nut and said blocking bar and comprising a first sleeve extending upwardly and fixed to said nut, and a second sleeve slidably telescoping on said first sleeve and connected at its upper end portion to said blocking bar means, whereby said blocking bar means is freely movable upward, but can be moved downward to playing position only by said drive means.

* * * * *